US005984714A

United States Patent [19]

Gerrans

[11] Patent Number: 5,984,714

[45] Date of Patent: Nov. 16, 1999

[54] ELECTRICAL CONNECTOR TAIL

[75] Inventor: Albert H. Gerrans, Hempstead, Tex.

[73] Assignee: A-G Geophysical Products, Inc., Cypress, Tex.

[21] Appl. No.: 08/960,800

[22] Filed: Oct. 30, 1997

[51] Int. Cl.[6] ..... H01R 13/56

[52] U.S. Cl. ..... 439/447

[58] Field of Search ..... 439/447, 445

[56] References Cited

U.S. PATENT DOCUMENTS

| | | | |
|---|---|---|---|
| 1,487,937 | 3/1924 | Griffin | 439/604 |
| 3,366,917 | 1/1968 | Karol | 439/447 |
| 3,521,220 | 7/1970 | Clarke, Jr. et al. | 439/447 |
| 4,355,855 | 10/1982 | Rebikoff | 339/94 |
| 4,481,381 | 11/1984 | Guazzo et al. | 174/135 |
| 4,718,860 | 1/1988 | Gobets et al. | 439/447 |
| 5,030,135 | 7/1991 | Plesinger | 439/447 |
| 5,058,172 | 10/1991 | Ross et al. | 439/447 |
| 5,120,268 | 6/1992 | Gerrans | 439/736 |
| 5,580,264 | 12/1996 | Aoyama et al. | 439/275 |
| 5,595,497 | 1/1997 | Wood | 439/282 |
| 5,641,307 | 6/1997 | Gerrans | 439/606 |

*Primary Examiner*—Paula Bradley
*Assistant Examiner*—Katrina Davis
*Attorney, Agent, or Firm*—The Matthews Firm

[57] ABSTRACT

Disclosed is a tail connected to and about an electrical connector and an electrical cable. The tail having a connector end and a conductor end and neck portion formed therebetween whereby the bending focal point is moved from the terminus of the conductor end and the cable to the neck portion of the tail.

13 Claims, 1 Drawing Sheet

ELECTRICAL CONNECTOR TAIL

BACKGROUND OF THE INVENTION

Underwater electrical cables and marine conductors in general cause major problems when they begin to leak. In some instances leakage is common due to the fact that such cables, and their connectors, commonly operate in subsurface environments, or in near surface atmospheric environments characterized by extreme salt and humidity, wave action, tugging and bending due to ships, boats or other vehicles and exposure to varying weather and environments. The primary sealing means in underwater connectors is generally the insulation encapsulating the strands of individual conductors, or it is an encapsulating material, such as plastic, around the housing of the connector constructed of stainless steal, plastic, high tech plastic or any alloy used for the connector. Frequently, these connectors are made of corrosion resistant metals, such as stainless steel, or the like, and are coated with a plastic or other resistant coating for the purpose of precluding entry of moisture.

Further, in marine seismic operations, underwater electrical plugs or connectors are needed to connect power and instrumentation conductors to other equipment, such as seismic sound generators, i.e. air guns. These "guns" are used as a sound source to obtain acoustic reflections from the sea-floor. Typically, they are fired every ten to fifteen seconds producing extremely strong pressure waves. As a result, the electrical, cables, conductors, and connectors are subjected to a great deal of structural abuse, and normally not last for extended periods of time before developing leaks or other operational defects. Typically, these components, such as electrical connectors, are exposed to such blasting forces and also to the extremely adverse nature of the environment and will not last long if they are not able to withstand the conditions. Therefore, all of the electrical connectors and other components used in these harshest of environments must necessarily withstand repeated explosive forces on their exteriors while allowing for a degree of flexibility within lest the internal conductor be jolted loose from its external housing.

Underwater electrical cables are also subject to movement due to currents, wave action, and the general movement of their fluid environment, which can cause the electrical cables to move in any variety of directions and to be tugged and yanked by the motion of the water. Underwater equipment is frequently connected to instruments on the surface, often to floating rigs on the surface of the water. The motion of the floating rig in relation to the underwater equipment produces great stress on the underwater electrical cable particularly at the cable connection to the underwater equipment. In particular, the connectors endure severe tugging and bending due to the vessel or ship and due to the energy emitted by the guns.

Generally underwater marine connectors are provided with a reinforced tail, which is a sheath of reinforcement around the cable insulation from the electrical connection to some point along the insulate electrical conducting cable to prevent excessive bending at the point where the rigid connector and the conductor are connected. This connector tail of reinforced insulating material protects the electrical cable from excessive bending, at the point where the conductor connects to the connector portion, which might crack the insulating material, exposing the electrical conductor to the water and creating a short of the electrical current. Electrical cables are particularly susceptible to such excessive bending near the point of connection between the electrical cable and the underwater equipment because the equipment fixes the one end of the cable in place, allowing no mobility of the cable to relieve bending stresses on the cable.

Prior Art tails create the bending focal point at the junction of the tail and the main conductor cable. This is because the prior art tails form a substantially rigid and extended reinforced section at the connection between the connector and the cable, thereby moving the bending point from the connection at the connector and cable to the end of the reinforced tail and the more limber and flexible cable. In such an instance, the tail itself, rather than protecting the cable from leakage, can become a source of resistance on the cable and increase the chances that the cable will split and leak at the focal point.

In the electrical connector tail of the present invention, the bending focal point is moved from the end or terminus of the tail, where the tail and cable meet to a point on the tail itself where the tail provides additional strength to the insulated conductors. This movement of the bending point is achieved by providing a reduced cross-sectional portion or neck portion in the tail. Because this neck portion is close to the connector end and conductor connection the bending occurs at the neck of the tail as opposed to the at the terminus of the tail where the insulated conductor provides little strength.

The problem of conductor cable leakage or breakage of the conductor at the junction of the cable and the connector tail is not limited to underwater or marine environments, but is also a problem in any situation where excessive bending of an electrical conductor threatens to compromise the integrity of the electrical circuit.

SUMMARY AND PURPOSES OF THE INVENTION

It is, therefore, an object of the present invention to move the focal point away from the end of the tail and toward the middle of the tail to eliminate cracking problems in the cable when under severe stress, such as over bending of the tail.

It is also an object of the present invention to change the bending focal point toward the middle of the tail by providing more reinforcing material to the tail at the end portion of the tail attached to the cable, providing added strength to this portion of the tail, so that the cable has less of a tendency to bend at the junction of the tail and the cable, and will preferentially bend in the middle portion of the tail.

It is further an object of the present invention to provide a tail that can withstand much greater bending forces due to the fact that there is complete bonding or fusion of the tail material and the cable insulating material.

The marine electrical connector tail of the present invention provides a "necking down" design that moves the focal point of bending from the end where the end of the tail and cable are fused together to the middle part of the tail, where the tail still provides significant reinforcement of the cable insulation.

The present invention provides an electrical connector tail, where the connector is connected to an insulated electrical conductor and the tail is disposed around the connector and the conductor, the tail comprising:

a connector end having a cross-sectional area;

a conductor end having a cross-sectional area; and a neck between the connector end and the conductor end, wherein the neck comprises a smaller cross-sectional area than the connector end and the conductor end.

The present invention also comprises a tail for an electrical connector, wherein the connector is connected to a flexible, insulated, electrical conductor, where the tail comprises:

a connector end attached to the electrical connector and having a first cross-sectional area; and a tail terminus attached to the insulated electrical conductor and having a second cross-sectional area;

wherein the tail tapers to a third cross-sectional area between the connector end and the terminus of the tail, the cross-sectional area being less than either of the first or second cross-sectional areas.

The present invention further comprises an electrical connector connected to an insulated, flexible electrical conductor, the connector comprising a flexible reinforcing sheath attached at one end to the connector, and attached at the other end to the conductor, wherein the sheath tapers between the ends such that the conductor preferentially bends around the tapered portion of the sheath.

The electrical connector tail of the present invention may be fused to the insulated conductor at the end of the tail where the tail is attached to the conductor cable.

The connector tail of the present invention is useful in marine and underwater environments, and is useful with connectors and conductor cables used in underwater marine environments.

DETAILED DESCRIPTION OF THE PREFERRED EMBODIMENT

Figure 1:
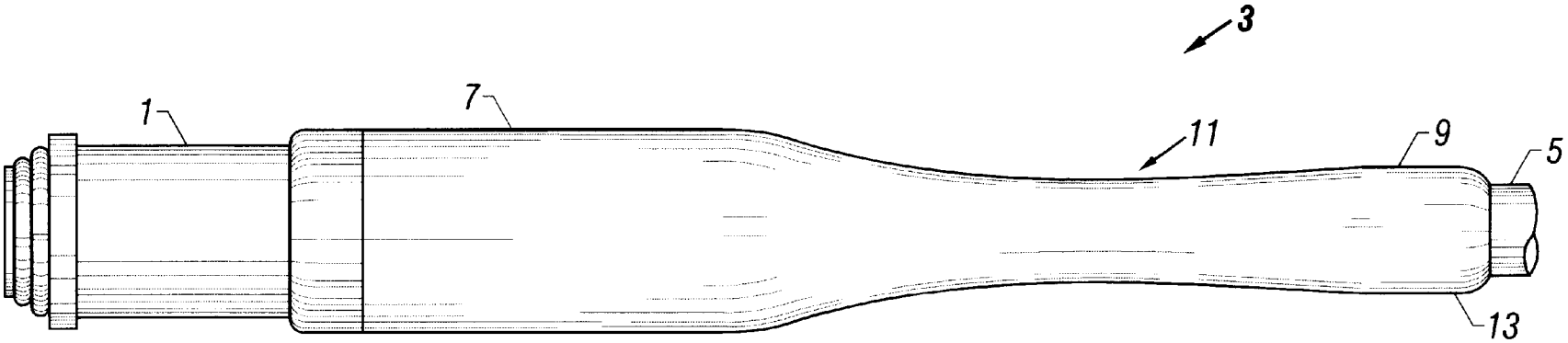
FIG. 1 is a side view of the electrical connector tail of the present invention.

FIG. 1 is a side view of the electrical connector tail of the present invention generally designated by the numeral 3. Connector tail 3 is connected between and about a connector 1 and an electrical cable 5. Connector 1 is adapted for connecting to underwater equipment. Tail 3, extends from connector 1 for some distance along cable 5. Tail 3 and cable 5 are made of a suitable insulating material such as flexible polyurethane, rubber or plastic. Tail 3 is comprised of a relatively larger cross-sectional area 7 around the connector 1, a narrower or smaller cross-sectional region 9 around cable 5 and a neck 11 between said larger area 7 and said narrower area 9. The neck 11 is the portion of the tail with the smallest cross-sectional area. Neck 11 tapers from the large cross-sectional area of segment 7 to a segment of smallest area 11 and then widens out to an intermediate cross-sectional area 9 where the tail 3 terminates at cable 5.

This "necking down" design of the tail moves the focal point from the terminus 13 of the tail 3 into the neck 11 of the tail 3, whereby the focal point or the flex point of the cable bending occurs at the neck 11 of the tail 3, rather than at the terminus 13 of the tail 3 as is the case in the prior art tails. By moving the focal point of bending into the neck of the tail 3, bending occurs at a reinforced region of the cable, thereby substantially reducing the likelihood of cracking of the cable due to excessive bending. Moving the focal point into the neck 11 of the tail 3 also reduces the amount that the cable can bend. That is, it reduces the maximum curvature of any bending, so that such bending is rarely excessive to the point of cracking the insulating material of the cable.

In the preferred embodiment of the present invention, the terminus 13 of the tail 3 is fused to the insulating material of cable 5. This fusion may be accomplished by any number of suitable means, such as the use of water insoluble adhesives, chemical bonding, extrusion processes or molding processes. Fusion of tail 3 with the cable 5 provides additional strength to the construction, further enhancing the reliability of tail 3.

Tail terminus 13 has extra material added in comparison to neck region 11. That is, the diameter of tail terminus portion 9 is slightly larger than the diameter of neck region 11. This extra material added to end portion 9 of tail 3 makes terminus portion 9 of tail 3 more rigid. The rigidity of the terminal portion 9 of tail 3 in comparison to the relative flexibility of neck 11, moves the focal point of bending away from terminus 13 and into neck 11. Cable 5, therefore, preferentially bends at neck 11 of tail 3, rather than at terminus 13 of tail 3 (at the junction between cable 5 and tail 3).

In the preferred embodiment, connector 1 and conductor cable 5 are substantially cylindrical or annular in shape. However, the present invention is also adaptable to other shapes of connectors and cables, including substantially flat, ovoid, rectangular, triangular, and the like.

The design of the tail of the present invention addresses a significant problem in underwater marine connectors by providing a connector with a reinforced tail which moves the focal point into the neck of the tail so that excessive stress due to over bending of the cable occurs at a reinforced portion of the tail greatly reducing the likelihood of cracking and leaking of the cable at the area of connection to underwater electrical equipment.

It will be clear to those skilled in the art that the tail of the present invention is useful not only in underwater environments, but is also generally useful for any electrical connector where excessive bending forces may raise concerns about the integrity of the electrical circuit.

The foregoing description of the invention is merely intended to be explanatory thereof. There are changes in the details and the materials of the described electrical connector tail which may be made within the scope of the appended claims without departing from the spirit of the invention as disclosed herein.

What is claimed is:

1. An electrical connector tail connected to an electrical connector, wherein said connector is connected to an insulated electrical conductor and said tail is disposed around said connector and said conductor, said tail comprising:

a connector end having a cross-sectional area;

a conductor end distal from said connector end and having a cross-sectional area that tapers decreasingly toward said connector end whereby said conductor end has a maximum cross-sectional area distal from said connector end; and a neck between said connector end and said conductor end, wherein said neck comprises a smaller cross-sectional area than said connector end and said maximum cross-sectional area of said conductor end whereby said neck bends and flexes.

2. The connector tail of claim 1, wherein said conductor end of said tail is fused to said insulated conductor.

3. The connector tail of claim 1, wherein said tail is used with an underwater electrical connector.

4. A tail for an electrical connector, wherein said connector is connected to a flexible, insulated, electrical conductor, and tail comprising:

a connector end attached to said electrical connector and having a first cross-sectional area; and a tail terminus attached to said insulated electrical conductor and having a second cross-sectional area;

wherein said tail tapers to a third cross-sectional area between said connector end and said terminus, said third cross-sectional area being less than either of said first or second cross-sectional areas whereby said neck bends and flexes.

5. The tail of claim 4, wherein said tail is used with an underwater electrical connector.

6. An electrical connector connected to an insulated, flexible electrical conductor, said connector comprising a flexible reinforcing sheath attached at one end to said connector, and attached at the other end to said conductor, wherein said sheath tapers between said ends such that said conductor preferentially bends around said tapered portion of said sheath; and wherein said end of said sheath connected to said conductor further comprises a maximum cross-sectional area substantially proximate to the end of said sheath attached to said conductor.

7. The electrical connector of claim 6, wherein said connector is used underwater.

8. The electrical connector of claim 6, wherein said end of said sheath attached to said conductor comprises additional reinforcement relative to said tapered portion of said sheath.

9. The electrical connector of claim 6, wherein said sheath is fused to said insulated conductor at said the end of said sheath attached to said conductor.

10. An electrical connector attached to a flexible electrical conductor, said connector comprising a reinforcing tail attached to said connector and to said conductor, said tail comprising a narrow middle portion, said narrow middle portion tapers between said connector and said conductor; and tail terminus portion that is wider than said narrow middle portion of said tail, whereby said conductor preferentially bends around said middle portion of said tail.

11. The electrical connector of claim 10, wherein said connector is used underwater.

12. A tail for an electrical connector, wherein said connector is connected to a flexible, insulated, electrical conductor, said tail comprising:

a connector end attached to said electrical connector and having a first cross-sectional area; and a tail terminus attached to said insulated electrical conductor and having a second cross-sectional area;

wherein said tail tapers to a third cross-sectional area between said connector end and said terminus, said third cross-sectional area being less than either of said first or second cross-sectional areas and wherein said tail terminus is fused to said insulated conductor whereby said third area bends and flexes.

13. The tail of claim 12, wherein said connector is used underwater.

* * * * *